US011205330B2

(12) United States Patent
Budano et al.

(10) Patent No.: US 11,205,330 B2
(45) Date of Patent: Dec. 21, 2021

(54) ANTI-THEFT RESPONSE RANDOMIZER

(71) Applicant: Indyme Solutions, LLC, San Diego, CA (US)

(72) Inventors: Joe Budano, San Diego, CA (US); Steve Deal, San Diego, CA (US)

(73) Assignee: Indyme Solutions, LLC, San Diego, CA (US)

( * ) Notice: Subject to any disclaimer, the term of this patent is extended or adjusted under 35 U.S.C. 154(b) by 0 days.

(21) Appl. No.: 16/700,977

(22) Filed: Dec. 2, 2019

(65) Prior Publication Data

US 2020/0193789 A1 Jun. 18, 2020

Related U.S. Application Data

(60) Provisional application No. 62/773,925, filed on Nov. 30, 2018.

(51) Int. Cl.
*G08B 13/24* (2006.01)
*G08B 13/14* (2006.01)

(52) U.S. Cl.
CPC ..... *G08B 13/248* (2013.01); *G08B 13/1436* (2013.01); *G08B 13/2417* (2013.01); *G08B 13/2448* (2013.01); *G08B 13/2462* (2013.01)

(58) Field of Classification Search
CPC ..... G08B 13/248; G08B 13/2462; G08B 13/1436; G08B 13/2417; G08B 13/2448; G08B 29/188; G08B 13/14; G08B 21/02; G08B 13/19613; G08B 15/002; H04L 12/282
See application file for complete search history.

(56) References Cited

U.S. PATENT DOCUMENTS 6,150,923 A * 11/2000 Johnson ..... G08B 3/10 340/384.1
7,541,926 B2 * 6/2009 Dugan ..... G08B 21/02 340/572.1
7,719,435 B2 * 5/2010 Readier ..... G08B 15/002 340/691.6
8,434,158 B2 * 4/2013 Ma ..... G06F 21/86 726/34
8,803,687 B2 * 8/2014 Valiulis ..... H04N 5/77 340/571
10,020,987 B2 * 7/2018 Donovan ..... H04L 41/069
10,186,124 B1 * 1/2019 Mullins ..... G08B 13/19682
2004/0012502 A1 * 1/2004 Rasmussen ..... G08B 13/04 340/870.16
2006/0181401 A1 * 8/2006 Martin ..... G08B 15/002 340/506
2007/0109134 A1 * 5/2007 Dugan ..... G08B 13/19608 340/573.1
2010/0039264 A1 * 2/2010 Bergman ..... G07C 9/00 340/572.1

(Continued)

*Primary Examiner* — Adnan Aziz
(74) *Attorney, Agent, or Firm* — Lewis Kohn & Walker LLP; David M. Kohn; Kari Moyer-Henry

(57) ABSTRACT

Systems and methods for maximizing the deterrence effect on theft. Specifically, systems and methods for selecting and randomizing at least one response to potential theft events while minimizing impact on store personnel productivity in a retail setting. A plurality of defined event triggers detected by a monitored source results in the randomization of response to detected event.

10 Claims, 1 Drawing Sheet

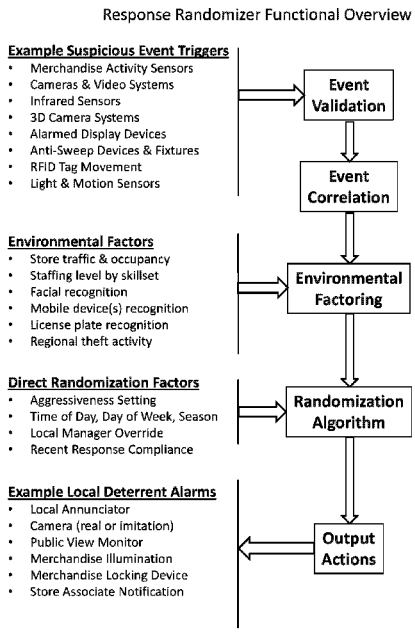

(56) References Cited

U.S. PATENT DOCUMENTS

| | | | | |
|---|---|---|---|---|
| 2011/0279261 | A1* | 11/2011 | Gauger | F16P 3/16 340/539.1 |
| 2012/0293329 | A1* | 11/2012 | Cunningham | G08B 13/1672 340/566 |
| 2014/0118144 | A1* | 5/2014 | Amis | G08B 21/02 340/540 |
| 2014/0359708 | A1* | 12/2014 | Schwartz | G06F 15/173 726/4 |
| 2015/0120015 | A1* | 4/2015 | Fadell | G06Q 10/0631 700/90 |
| 2017/0092095 | A1* | 3/2017 | Weast | G06K 9/00771 |
| 2017/0256148 | A1* | 9/2017 | King | G08B 13/1436 |
| 2018/0219695 | A1* | 8/2018 | Lundy | H04L 41/0803 |
| 2019/0035242 | A1* | 1/2019 | Vazirani | G08B 25/001 |

* cited by examiner

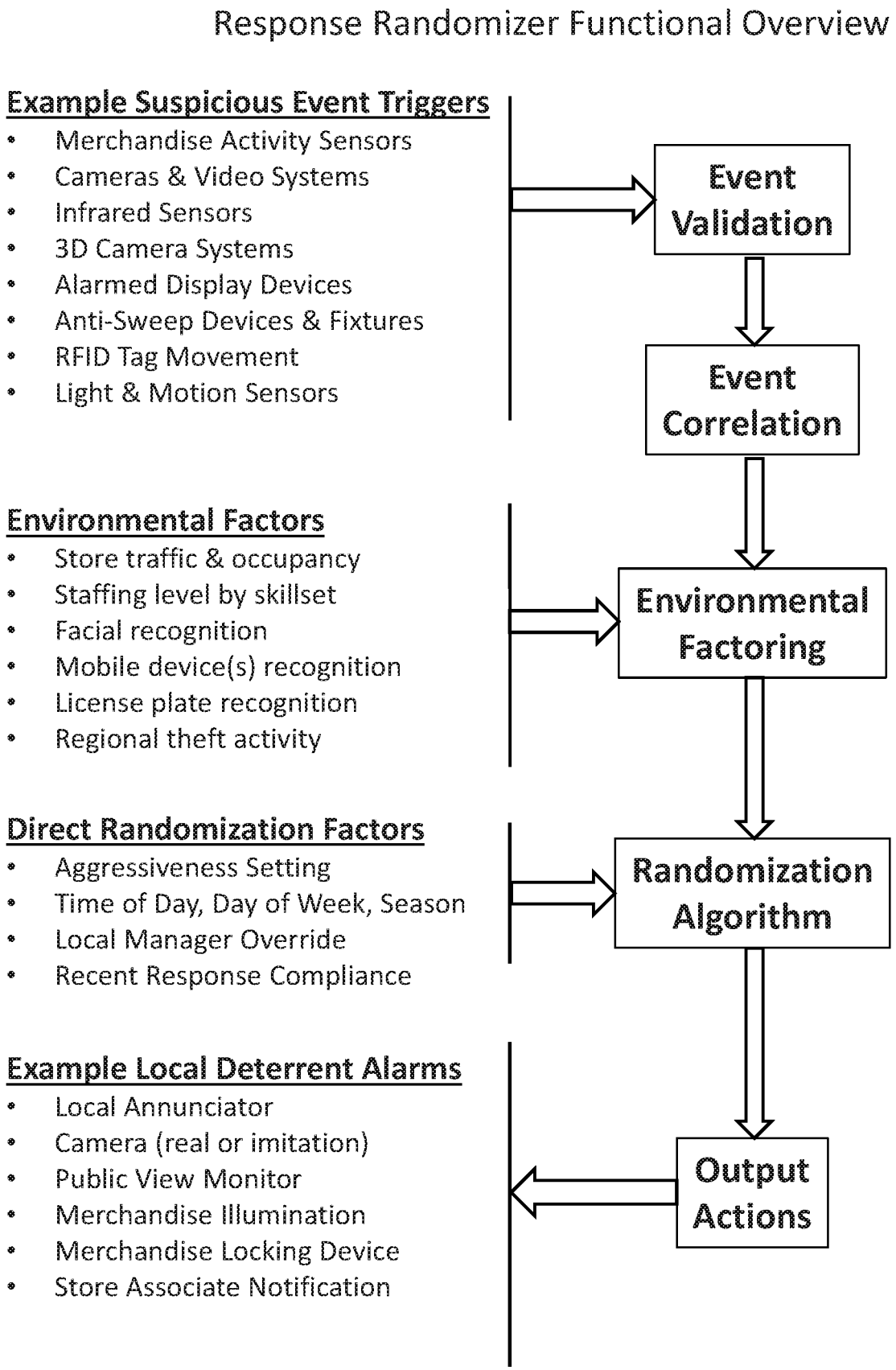
Response Randomizer Functional Overview
Example Suspicious Event Triggers
• Merchandise Activity Sensors
• Cameras & Video Systems
• Infrared Sensors
• 3D Camera Systems
• Alarmed Display Devices
• Anti-Sweep Devices & Fixtures
• RFID Tag Movement
• Light & Motion Sensors
Event Validation
Event Correlation
Environmental Factors
• Store traffic & occupancy
• Staffing level by skillset
• Facial recognition
• Mobile device(s) recognition
• License plate recognition
• Regional theft activity
Environmental Factoring
Direct Randomization Factors
• Aggressiveness Setting
• Time of Day, Day of Week, Season
• Local Manager Override
• Recent Response Compliance
Randomization Algorithm
Example Local Deterrent Alarms
• Local Annunciator
• Camera (real or imitation)
• Public View Monitor
• Merchandise Illumination
• Merchandise Locking Device
• Store Associate Notification
Output Actions

ANTI-THEFT RESPONSE RANDOMIZER

RELATED APPLICATIONS

This application claims the benefit of priority of U.S. Provisional Patent Application No. 62/773,925 filed on Nov. 30, 2018, the disclosure of which is hereby incorporated by reference in its entirety.

FIELD OF THE INVENTION

The present invention pertains generally to loss prevention technologies. More particularly, the present invention pertains to sensors and systems for use in retail settings in order to facilitate more effective customer service, reduce theft and to provide additional analysis data related to merchandise/shopper interaction.

BACKGROUND OF THE INVENTION

The theft of retail store merchandise increasingly damages financial performance of retail operations and translates into material cost penalties to all consumers. Perpetrators of these crimes can be categorized into three groups: the occasional shoplifter (opportunistic theft); store associates (internal theft); and theft by professional thieves, also known as Organized Retail Crime (ORC). Although this invention targets all three kinds of criminals, it's most effective against ORC type theft.

According to Loss Prevention (LP) magazine, an ORC group is defined as the association of two or more persons engaged in illegally obtaining retail merchandise in substantial quantities through both theft and fraud as part of an unlawful commercial enterprise. These ORC rings are typically responsible for the vast majority of retail shrink losses. These groups are very effective because they are highly organized, operate in crews, steal large quantities of merchandise when they hit a store, and usually hit multiple stores in a local market in a single day. Because of the high level of financial loss they create, thwarting ORC groups is a priority of any product protection system.

LP magazine further reports that the primary objective of these professional crime rings is to steal from retail organizations for the purpose of turning retail products into financial gain, rather than for personal use. Typically coordinated under well-planned procedures and rules, organized retail crime can operate on a local, regional, national or international scale. These intricate criminal operations are responsible for tens of billions of dollars in losses each year that can devastate a retail business.

ORC operations range from simple to extremely complex, often involving organizers, boosters, fencing operations, re-packagers, and even illegitimate wholesale operations. Members are often recruited and well-trained, with each collaborator having a specific role to fill in the operation. Sophisticated techniques may be used, to include advanced communications and the latest technology. Working together, teams typically steal thousands of dollars of merchandise from multiple retailers in a single day.

While exploited product lines can include almost anything, targeted products almost always share some or all of the following key characteristics:

Considered valuable or in high demand;

Easily accessible to consumers (and thieves);

Easily concealed to avoid detection when stolen;

Expansive availability and demand, especially in different stores or markets;

Innovative or offers premium performance that is highly attractive to "customers";

Easily sold and convert to cash.

Based on this model and documented theft trends, it is apparent that ORC groups steal a wide array of products including over-the-counter drugs, razor blades, baby formula, cigarettes, batteries, video games, DVDs, gift cards, jewelry, large or small electronics, designer clothing, power tools, high-end meats, or any number of items that are in high demand.

According to the National Retail Foundation, ORC costs the retail industry approximately $30 billion each year. It is continuing to grow, with 83 percent of merchants surveyed in 2017 reporting an increase in the past year. The financial impact of ORC is considerable, costing retailers an average of $726,351 per every $1 billion in sales.

However, the financial loss extends well beyond the actual cost of merchandise and the ongoing and increasing costs related to deterring and apprehending thieves. For example, ORC boosters often steal the entire inventory of targeted merchandise. The automatic replenishment system is unaware of the lost merchandise and thus the need to restock is delayed since the retailer's inventory system is unaware of this event. Consequently, subsequent shoppers are unable to purchase desired items, resulting in lost sales and, even worse, the loss of frustrated loyal customers—each of which may represent thousands of dollars of sales loss per year.

While the investment in labor and technology combating the ORC scourge has been considerable, actual deterrence and recovery is disappointing. According to the Jack L. Hayes International $29^{th}$ Annual Retail Theft Survey, for every $1 recovery made by the 23 major retailers that responded to the survey, $12.82 was lost to retail theft. Hayes International consultants therefore calculated that only 7.8 percent of total retail theft losses resulted in a recovery.

Current Approaches are Ineffective

Despite heavy investment in technologies that include camera systems, exit alarms, public view monitors, various locking mechanisms, presence and merchandise movement detection sensing, and many more, barely a dent has been made in the problem. Some of these technologies can detect suspicious activity and alarm or provide notification to store personnel. However, experienced ORC boosters observe and assess how these predictable sensing and notification technologies work and, once understood, adjust their methods accordingly. In short, it is the predictable and obvious cause-and-effect nature of these technologies—both to thieves and store personnel (who often exhibit poor response compliance from repetitive notifications)—that tend to render them increasingly ineffective at deterring theft over time.

One well known example is Electronic Article Surveillance (EAS) which sounds an alarm at the store exit every time tagged but unpurchased merchandise exits the store. The alarms from these systems have become so repetitive, and the frequency of false alarms so prevalent, that even store employees rarely pay attention to these alarms. Thieves and even customers have learned to simply ignore the alarm and keep walking. Many retailers sadly admit that they purchase EAS systems, not because they are all that effective, but only because not having one makes them a more attractive target when all other nearby retailers have one.

In another example, if a device that detects merchandise removal from a shelf always alarms each time five or more items are removed, the thief quickly learns to only remove four items at a time. Again, this predictability encourages the thief to adapt.

Associate Response

It is known that one of the most effective ways to thwart ORC theft is store personnel approaching the thief and offering service. If this happens repeatedly, the ORC thief will find stealing from that store uncomfortable and his/her perceived risk of apprehension increases. Unfortunately, involving store personnel is costly in terms of labor cost and utilization of resources. Additionally, if store personnel are repeatedly notified to approach customers (and potential thieves) in the hope of thwarting theft, over time store personnel will fatigue and ultimately fail to comply with this process.

Unpredictable Responses

ORC thieves fear unpredictable responses as they can no longer confidently operate with knowledge of predictable store defenses. Professional thieves often "case the store" and test antitheft devices to identify predictable response patterns. They are then equipped to devise a theft strategy circumventing identified predictable responses. However, when responses are not predictable, the resulting uncertainty prompts the thief to steal elsewhere. The intention of the invention is to reinforce this uncertainty-driven fear. Implementing the invention decouples suspicious activity detection from the same resulting predictable response events (regardless of the type of event or the detection method being used). Instead, a variety of environmental factors are considered within a "randomization process" resulting in variation in type and frequency of alarms and notifications (that is, alarm and notification actions no longer necessarily correlate on a 1:1 basis with detected suspicious events).

The ultimate objective of the invention is to maximize the deterrent effect on theft while minimizing labor impact on lean store teams in such a way that team compliance with response policies improves. On this latter point, experience reveals that overwhelmed teams ultimately ignore these notifications (as they already do with EAS, as noted previously), reducing the value of timely store associate response to suspicious events.

SUMMARY OF THE INVENTION

The present invention provides for a system for maximizing theft deterrence in a retail setting comprising:

(a) providing at least one monitored source programmed to identify one or more suspicious events related to an action of an individual;

(b) evaluating the risk associated with the one or more suspicious events;

(c) considering one or more environmental factors once the one or more suspicious event is identified (d) selecting among one or more response types based on (b) and (c); and (e) randomizing the one or more response types.

Preferably, the at least one monitored source is selected from the group consisting of merchandise activity sensors monitoring vibration or product removal, RFID detection, weight detection cameras, infrared sensors, alarmed display devices, light and motion sensors and perimeter sensors. Optionally, the at least one monitored source is capable of detecting merchandise removal from fixtures, removal of packaging from merchandise, concealment of merchandise, removal of price or security tags from merchandise, or any other detection of theft related activity.

More preferably, the one or more environmental factors is selected from the group consisting of store traffic, staffing levels, facial recognition, mobile device recognition, regional activity, event correlation, response compliance, time of day and manual adjustment of settings. Similarly, the one or more response types may be one selected from the group consisting of local deterrent alarm, store personnel notification, notification of adjacent stores and remote notifications.

In another aspect, the present invention provides a method of selecting and randomizing at least one response to potential theft events while minimizing impact on store personnel productivity in a retail setting, the method comprising:

(a) providing a security system configured to identify one or more suspicious event triggers from at least one sensor or monitoring system;

(b) considering one or more environmental factors once the one or more suspicious event triggers is identified;

(b) selecting a response type from the security system based on the one or more suspicious event triggers after considering the one or more environmental factors;

(c) allowing the security system to execute the response type, wherein the response is randomized, resulting in an inability to determine any relationship between the one or more suspicious event triggers and the response from the security system. Optionally, the at least one sensor or monitoring system is selected from the group consisting of merchandise activity sensors monitoring vibration or product removal, RFID detection, weight detection cameras, infrared sensors, alarmed display devices, light and motion sensors and perimeter sensors.

More preferably, the one or more environmental factors is selected from the group consisting of store traffic, staffing levels, facial recognition, mobile device recognition, regional activity, event correlation, response compliance, time of day and manual adjustment of settings. Similarly, the one or more response types may be one selected from the group consisting of local deterrent alarm, store personnel notification, notification of adjacent stores and remote notifications.

In yet another aspect, the present invention provides for a method of reducing merchandise shrink while minimizing impact on store personnel and shopper experience in a retail environment, the method comprising:

(a) providing a system capable of detecting and identifying one or more suspicious event triggers from at least one sensor or monitoring system;

(b) considering one or more environmental factors once the one or more suspicious event is identified; and (c) determining at least one response from the system, wherein the at least one response is randomized such that no pattern may be established between the one or more suspicious event triggers and the at least one response. Optionally, the at least one sensor or monitoring system is selected from the group consisting of merchandise activity sensors monitoring vibration or product removal, RFID detection, weight detection cameras, infrared sensors, alarmed display devices, light and motion sensors and perimeter sensors.

More preferably, the one or more environmental factors is selected from the group consisting of store traffic, staffing levels, facial recognition, mobile device recognition, regional activity, event correlation, response compliance, time of day and manual adjustment of settings. Similarly, the one or more response types may be one selected from the group consisting of local deterrent alarm, store personnel notification, notification of adjacent stores and remote notifications.

The purposes of the invention are to maximize theft deterrence, minimize productivity impact on store associates, and maintain or even contribute to a positive shopper experience.

Maximizing deterrence is accomplished by randomizing the response to detected suspicious events such that a thief cannot predict how the product protection system will react, thus increasing the perceived risk of apprehension and hindering the thief's development of a circumventing strategy. This is achieved by injecting unpredictability between the detection of events indicative of possible theft activity and the resulting response to such events. The invention accepts suspicious event triggers from virtually any type of sensor or monitoring system and then "randomizes" response actions, including activation of various local deterrent devices and/or notifications directing store personnel to the location of the activity of interest.

Minimizing the impact on store personnel productivity and shopper experience is accomplished by limiting and varying the type and number of responses generated by detected suspicious events. Response requests dispatching store personnel are reduced by randomizing the requirement to respond. The invention's randomization process reduces the response rate to detections from 1:1 with no randomization to virtually any ratio based on a number of intelligent factors. For example, in its simplest form, store personnel may be notified to respond to only one of every five detected suspicious events. In this case, randomization reduces such requests by 80% and yet the thief would be unaware if or when they would be approached by a store associate. Randomization also improves store associate compliance with antitheft policies. When the number of response requests decreases, response compliance tends to increase. From the perspective of the thief, a store associate may or may not be encountered; worst yet, the thief has no idea of when this might happen. From a shopper's perspective, assistance will seemingly proactively be offered by a responding store associate. This is a win for all involved. Furthermore, randomization can be applied not only to store associate responses but the activation of local deterrent devices as well.

From Simple to Complex Randomization

Instead of repetitive and predictable response actions to detected suspicious events, as is the present practice, the invention varies the frequency and actions of the response. This is accomplished through quasi-randomization techniques, driven by proprietary algorithms, which typically consider various environmental factors and other variables. The result is that detected suspicious activity may or may not cause the same response or notification, or may seemingly randomly change the type of or mode of response or notification issued.

This randomized response to suspicious activity provides several benefits:

1) Increase in thieves' perceived risk of apprehension;
2) Confounds thieves efforts to devise strategies that circumvent anti-theft devices;
3) Reduces dispatch notifications to store personnel
   a. Contribute to store team productivity and reduces the recurring cost to deploy anti-theft devices;
   b. Fewer requests tends to increase store team compliance with response policies;
4) Improves the shopper experience by varying and/or limiting anti-theft device activations so legitimate shoppers are less frequently disturbed by alarms, tones or video recording devices.

The invention typically initiates a variety of seemingly random responses from identical detected suspicious activities, making it quite challenging for an observer to determine what actions trigger a given sensor type since there is no obvious relationship between a set of actions and a responsive outcome. For example, perhaps a sensor detects rapid removal of five items from a merchandise shelf—an action defined as possibly an ORC booster sweep in process. This identical action may sometimes trigger a notification through a communication device (such as a radio, smart phone, pager, etc.) summoning store personnel to the location; sometimes no such notification is issued; other times, instead of a notification, the action may trigger an autonomous local deterrence response such as an announcement through a nearby overhead speaker that a customer needs assistance at that location; and/or the "recording light" on a nearby camera may start flashing to indicate remote surveillance has been activated.

Since timely response by store personnel to notifications is acknowledged as the most effective deterrent, a further objective of the invention is to increase store personnel response compliance to notifications. This is accomplished by reducing the sheer volume of notifications, avoiding identical notifications in rapid succession, and considering various environmental factors (such as the significance of the threat and the probable availability of store personnel to respond) in determining when notifications should or should not be issued.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 1 illustrates an overview of the response randomizer of the present invention.

DETAILED DESCRIPTION OF THE INVENTION

With reference to FIG. 1, the basic operating sequence of the invention is to:

1. Accept suspicious activity event triggers from various monitored sources (sensors and/or systems and human input);
2. Evaluate the nature of the suspicious activity;
3. Correlate that event with any others that may be relevant;
4. Identify, evaluate, and apply the applicable environmental factors and variables;
5. Select among a range or response types;
6. Apply an appropriate level of randomization;
7. Initiate the optimal response (local alarm and/or notification action(s), if any).

The invention can accept suspicious event triggers from virtually any type of device or system capable of detecting events of interest; examples include but are not limited to:

Merchandise Activity Sensors monitoring vibration induced into store fixtures when merchandise is removed;

Merchandise Activity Sensors of any kind that detect the removal of merchandise from store fixtures.

Cameras & Video Management Systems capable of detecting suspicious behavior (such as unusual loitering, rapid product removal or any unusual shopping behaviors);

Infrared Sensors detecting presence dwell (loitering) at high risk locations and reaches into merchandise displays (i.e., an infrared "curtain" detecting merchandise interaction);

3D Camera Systems monitoring removal of merchandise from a store fixture;

Alarmed Display Devices, often connected to cameras and other high end items, that permit shoppers to pick up the item but that detect if the attached restraint is removed;

Anti-Sweep Devices & Fixtures that limit and/or mechanically monitor merchandise removal (includes instrumented locked dispensing fixtures, twist knob dispensing devices, flip doors, merchandise pushers, and peg hooks);

RFID detecting tag movement from a shelf or a defined area;

Light & Motion and similar devices outfitted with a transmitter that are mounted to merchandise to detect suspicious handling or, by virtue of numerous such devices subjected to near-simultaneous movement (which may suggest an in-process theft sweep);

Fitting room occupancy sensors;

Shopping cart sensor systems that detect a path to the store exit without a passing through a cashier station;

Unauthorized presence sensors behind jewelry or other service counters; and

Perimeter door switches.

Once a trigger is received from one or more of the above sensing techniques, the invention evaluates recent alarm activity from the originating source and the system overall along with various environmental factors to determine what, if any, alarm or staff notification will be issued.

These environmental factors may include one or more of the following:

Store Traffic/Occupancy: The store's traffic monitoring system provides real time information on the quantity of persons entering and exiting the store, providing a means of determining the approximate quantity of people in the store at a given time;

Staffing Level by Skillset: The store's time clock system provides information on the quantity of employees by skillset available in the store at a given time;

Facial Recognition: The store's facial recognition system (typically of persons entering the store) can provide notification of the presence of known or suspected high risk individuals;

Mobile Device Recognition: Mobile devices previously detected and associated with suspicious activity in this or other stores indicate the presence of suspected high risk individuals;

License Plate Recognition: Vehicle plates associated with known or suspected high risk individuals or groups entering the store's parking lot;

Regional Activity: Real time sharing of detected or known theft activity among stores in a geographical area (this may include human reporting of actual theft events, facial and/or license plate recognition information or may simply be limited to activity related to events of interest, such as likely ORC sweep events);

Event Correlation: Receipt of triggers of other relevant events within a reasonable time proximity; for example, separate merchandise movements (on nearby display locations or even throughout the store) that might collectively represent theft sweep activity;

Response Compliance: Some systems incorporate a means of confirming response by store personnel to a detected event; for example, a notification of a sweep event may be sent to store personnel who, upon responding to the area, press a button in that area or are otherwise confirmed to have responded within a reasonable time; this compliance rate may influence the probability of notifications to store personnel to subsequent detections;

Randomizer: In addition to considering any combination of the above factors, the invention can be configured to randomly process event triggers within prescribed algorithm limits;

Time of Day/Week/Year: Each of these three timing factors may be taken into account by the invention in determining trigger processing;

Manual Adjustment: Based on observation or other factors, a manager or other authorized person can direct the invention to increase or decrease the level of aggressiveness of notifications either temporarily, or optionally, as a general setting.

While systems configurations and their capabilities vary considerably, once the invention evaluates the event trigger and relevant environmental factors, it determines what response action(s) a given event will then trigger. Available response actions may include, but are not limited to, one or more of the following:

Local Deterrent Alarm: Sound and/or light in proximity to the suspicious event gains the attention of nearby persons (especially thieves, who are typically hyper alert); these local alarms may manifest in a variety of form factors including:

- Local Annunciator: Typically a basic device with a speaker and lights;
- Camera: Could be a real or imitation camera outfitted or associated with a speaker or other audio device and/or lights;
- Public View Monitor (PVM): These video display with integral camera units are often mounted in the vicinity of high theft activity and may be activated to take increasingly aggressive sound, light, and video display actions depending on the situation;
- Increased illumination of merchandise: Simply turning on additional lighting in the area of interest.
- Locked Merchandise: Initiating an automated locking mechanism that prevents removal of merchandise from a fixture
- Any other theft deterrent action: The Randomizer can activate any theft deterrent device Store Associate Notifications: All or select store personnel may be notified using various communication channels including Public Address systems, two-way radios, pagers, wireless phones, and mobile smart devices;

Notification of Adjacent Stores: Notification of stores within a limited distance from the store which experienced a large theft event is helpful as ORC rings hit multiple stores in a market in the same day.

Remote Notifications and VMS Integrations: Especially situations in which store video cameras are monitored/analyzed at a remote monitoring station, the invention uses network and other communication channels to notify remote monitoring personnel and/or automated Video Management Systems (VMS).

While the actual evaluation algorithms are a highly configurable trade secret, the following information provided below at Table 1 discloses how various environmental factors may be considered.

TABLE 1

| Algorithm Variables | | |
|---|---|---|
| Factor | Description | Typical Impact |
| Store Traffic | Using store entry traffic count sensors and exit sensors and/or average shopping duration metrics, approximate number of shoppers in the store is determined. | As the ratio of shoppers to available store associates (sometimes based on event location and associate skillsets), the threshold to triggering in-store response notifications increases (i.e., notifications will be less likely to trigger in limited resource situations). |
| Staffing Level | Using time clock and POS login activity and data, the quantity of available store associates by skillset is determined. | |
| Facial Recognition | Persons entering the store and/or at locations within the store are compared with a database to identify individuals or groups of individuals known or suspected to be involved with theft. | The identification itself may trigger a notification event; additionally, any other events (especially if associated with a past modus operandi, such as the theft of razor blades) will be handled with higher aggressiveness. Two or more persons of interest in close time proximity who were previously detected as a group also increases aggressiveness. |
| Mobile Device Recognition | Similar to facial recognition but identification is made through identifiable signatures of mobile phones carried by persons of interest. | |
| License Plate Recognition | A camera at the parking lot entrance or other location(s) detects license plate numbers to determine if past events of interest correlate with that plate. | |
| Regional Activity | Nearby stores within a chain or cooperating stores of different chains provide real-time notification of select events of interest (especially theft sweeps likely performed by ORC teams). | As ORC teams often target a series of nearby stores - typically sweeping the same items - awareness of a team operating nearby increases alarm and notification frequency and aggressiveness. |
| Event Correlation | All event triggers received within a reasonable time frame are evaluated for possible correlation with each other. | If individual events are determined to likely correlate to a suspicious activity, action aggressiveness and response frequency increases. |
| Response Compliance | Confirmation of store personnel responding to an event of interest in a timely fashion.* | Poor compliance will typically increase notification aggressiveness (e.g., reducing the threshold justifying a notification and speeding escalations to management). |
| Randomizer | After all environmental factors are considered, the selection and frequency or responses is then randomized to, 1) create uncertainty, 2) limit resource utilization and 3) increase compliance | The randomizer action reduces the percentage of notifications and the actual response and associate notifications occur in a random fashion. |
| Time of Day/Week/Year | Identifying time frames during which specific system actions are desired (e.g., high/medium/low event action aggressiveness); these are often related to anticipated shopper traffic, staffing levels, and known theft vulnerability (perhaps related to specified store zones). | The algorithm uses the specified action level as a final consideration as to what, if any, action(s) will be taken in response to a given event). |
| Manual Adjustment | Authorized personnel (such as store management) temporarily adjust notification aggressiveness based on conditions. | Aggressiveness adjusts for a specified duration of time. |

*A variety of methods can be used to confirm response to an event of interest. Proactive methods include pressing a button or scanning a bar code located in that area, among other similar methods. Automated methods include video or beacon detection of the presence of a responding employee.

EXAMPLES

A great example of the invention in use can be shown through protection of the "cosmetics wall" at a national drug store chain. In any drug store chain, one of highest revenue and profitability categories, besides prescription drugs, is cosmetics. Unfortunately, it is also the highest theft area in the store. The cosmetics category has many characteristics which make it particularly vulnerable and attractive to thieves:

1) Items tend be relatively high priced ($10 or more);
2) Thousands of SKUs (many unique products);
3) Small size makes them easily concealed;
4) High total value of products can be stolen with little physical volume of goods;
5) High product demand (especially hot new lines of cosmetics);
6) Easily resold through alternate channels (eBay, swap meets, resold to other retails, moved internationally etc.)
7) Drug stores deploy very few personnel; most are unable to leave the cash register area;
8) Stores are often open 24 hours with very limited personnel during late night hours.

These characteristic make this category highly attractive to all three theft categories: opportunistic, internal, and ORC. However, due to the large quantities of merchandise stolen in each theft event, ORC theft typically represents more than half of total losses. In their highest shrink stores, this chain experiences more losses from theft than is earned in sales, resulting in a net loss for the category. In addition, following an ORC theft event, the shelves of targeted brands are literally stripped clean of merchandise. This severely erodes sales as subsequent shoppers can no longer purchase the product. In this chain's case, despite numerous efforts and approaches to reduce cosmetics theft, shrink continued to increase year over year. Given these failures, the chain elected to install a new product protection system incorporating many elements of this invention.

In this application, two types of devices were installed in the cosmetics category.

1) Merchandise movement detection devices which count items being removed from shelves. These sensors were affixed to shelves with the most theft-prone products to detect when excessive items were removed within a short time frame. For example, removal of five or more units in less than 10 seconds strongly suggests an in-progress ORC theft event (a sweep event).

2) A simulated Dome Camera was installed over the cosmetics sales area. This highly visible device, with the outward appearance of a security camera, detects people dwelling in front of cosmetics merchandise. The device can annunciate voice messages and illuminate integral lights which, when flashing, simulate the initiation of active security surveillance.

A range of responses initiated when a suspicious event was detected. These responses fall into two broad categories: a) local deterrents, such as attention-getting tones or voice announcements, flashing lights, activation of Public View Monitors etc. and b) notification of store personnel via walkie talkies, the store's Public Address system, or other channels. These two categories of responses were individually randomized by the invention.

Given the staffing constraints of this drug store environment, store personnel notifications had to be severely limited even though, as noted previously, store personnel response is the optimal action to stop an ORC event in progress. Still, given the sophistication of the professional ORC thief, the local response also had to be unpredictable. All the while, these same devices had to deter opportunistic theft as well as internal theft. Under these considerations, the invention was deployed to randomize the response with algorithm variances influenced by time of day, day of week, store staffing characteristics, the type of thief being impacted, and inherent store shrink profile. The deployment of the invention had these behavioral impacts:

1) The random nature of the responses made ORC thieves particularly uncomfortable;
2) ORC thieves could no longer devise strategies to thwart predictable responses;
3) Opportunistic thieves received immediate local deterrents, driving a heightened sense of physical security in the area;
4) Store personnel were notified to respond to the area a small fraction of the time driving their compliance with such requests to very high levels.

CASE RESULT: After years of increasing cosmetic category shrink, this chain experienced an immediate and sustained 52% reduction in shrink directly resulting from the deployment of the invention. It was simply wholly impractical for the sensors to be deployed absent the randomization of the response. The invention alone enabled the functioning of the sensors to be not only effective against thieves but, perhaps more importantly, compatible with the constraints and realities of this challenging retail environment.

What is claimed is:

1. A system for maximizing theft deterrence in a retail setting comprising:

(a) providing at least one monitored source programmed to identify one or more suspicious events related to an action of an individual;

(b) evaluating the risk associated with the one or more suspicious events;

(c) selecting among one or more response types based on (b), wherein the one or more response types is selected from the group consisting of local deterrent alarm, store personnel notification, notification of adjacent stores, remote notifications and no notification of store personnel; and (d) randomizing the one or more response types based on results in (c), wherein the randomized response results in an inability of the individual being monitored to determine any relationship between the one or more suspicious events related to an identical action of the individual and the response from the system.

2. The system of claim 1, wherein the at least one monitored source is selected from the group consisting of merchandise activity sensors monitoring vibration or product removal, RFID detection, weight detection, cameras, infrared sensors, alarmed display devices, light and motion sensors and perimeter sensors.

3. The system of claim 1, wherein the at least one monitored source is configured to detect merchandise removal from fixtures, removal of packaging from merchandise, concealment of merchandise, removal of price or security tags from merchandise, or any other detection of theft related activity.

4. The system of claim 1, further comprising one or more environmental factors, the one of more environmental factors is selected from the group consisting of store traffic, staffing levels, facial recognition, mobile device recognition, regional activity, event correlation, response compliance, time of day and manual adjustment of settings.

5. A method of selecting and randomizing at least one response to potential theft events while minimizing impact on store personnel productivity in a retail setting, the method comprising:

(a) providing a security system configured to identify one or more suspicious event triggers from at least one sensor or monitoring system that is monitoring an individual;

(b) considering one or more environmental factors once the one or more suspicious event triggers is identified;

(c) selecting one or more response types from the security system based on the one or more suspicious event triggers after considering the one or more environmental factors, wherein the one or more response types is selected from the group consisting of local deterrent alarm, store personnel notification, notification of adjacent stores, remote notifications and no notification of store personnel;

(d) allowing the security system to execute the one or more response types based on results from (c), wherein the response is randomized, resulting in an inability of the individual being monitored to determine any relationship between the one or more suspicious event triggers related to an identical action of the individual and the response from the security system.

6. The method of claim 5, wherein the at least one sensor or monitoring system is selected from the group consisting of merchandise activity sensors monitoring vibration or product removal, RFID detection, weight detection, cameras, infrared sensors, alarmed display devices, light and motion sensors and perimeter sensors.

7. The method of claim 5, wherein the one or more environmental factors is selected from the group consisting of store traffic, staffing levels, facial recognition, mobile device recognition, regional activity, event correlation, response compliance, time of day and manual adjustment of settings.

8. A method of reducing merchandise shrink while minimizing impact on store personnel and shopper experience in a retail environment, the method comprising:

(a) providing a system configured to detect and identify one or more suspicious event triggers from at least one sensor or monitoring system that is monitoring an individual;

(b) considering one or more environmental factors once the one or more suspicious event triggers is identified; and (c) determining one or more response types from the system based on the results in (b), wherein the one or more response types is selected from the group consisting of local deterrent alarm, store personnel notification, notification of adjacent stores, remote notifications and no notification of store personnel; and (d) executing the one or more response types based on the results from (c), wherein the response is randomized, resulting in an inability of the individual being monitored to determine any relationship between the one or more suspicious event triggers related to an identical action of the individual and the response from the system.

9. The method of claim 8, wherein the at least one sensor or monitoring system is selected from the group consisting of merchandise activity sensors monitoring vibration or product removal, RFID detection, weight detection, cameras, infrared sensors, alarmed display devices, light and motion sensors and perimeter sensors.

10. The method of claim 8, wherein the one or more environmental factors is selected from the group consisting of store traffic, staffing levels, facial recognition, mobile device recognition, regional activity, event correlation, response compliance, time of day and manual adjustment of settings.

* * * * *